US006808360B1

(12) United States Patent
Patterson

(10) Patent No.: US 6,808,360 B1
(45) Date of Patent: Oct. 26, 2004

(54) APPARATUS AND METHOD FOR LIFTING AND ROTATING PIPES

(76) Inventor: Morris D. Patterson, 1610 Winchester Rd., Huntsville, AL (US) 35811

( * ) Notice: Subject to any disclaimer, the term of this patent is extended or adjusted under 35 U.S.C. 154(b) by 366 days.

(21) Appl. No.: 10/141,465

(22) Filed: May 8, 2002

(51) Int. Cl.[7] ..... B66C 1/66

(52) U.S. Cl. ..... 414/746.5; 294/89; 294/90; 294/93; 414/783; 414/815; 414/816; 414/910

(58) Field of Search ..... 294/89, 90, 93, 294/96; 414/731, 746.5, 783, 815, 816, 910

(56) References Cited

U.S. PATENT DOCUMENTS

| | | | | |
|---|---|---|---|---|
| 1,890,734 A | | 12/1932 | Kuberka | |
| 2,584,124 A | | 2/1952 | Gustafson | |
| 3,132,890 A | | 5/1964 | Beaudet | |
| 3,307,871 A | | 3/1967 | Russell et al. | |
| 3,385,627 A | | 5/1968 | Zumbo | |
| 3,583,753 A | | 6/1971 | McCrory | |
| 3,972,554 A | * | 8/1976 | Tryon | 294/97 |
| 4,154,470 A | * | 5/1979 | Dalglish | 294/93 |
| 4,320,915 A | * | 3/1982 | Abbott et al. | 294/96 |
| 4,838,595 A | | 6/1989 | Spillar | |
| 4,941,798 A | * | 7/1990 | Meier | 414/619 |
| 5,332,272 A | | 7/1994 | Prince | |
| 5,482,341 A | | 1/1996 | Schmitz, Jr. | |
| 5,820,186 A | | 10/1998 | Schmitz, Jr. et al. | |

FOREIGN PATENT DOCUMENTS

JP 02169492 A * 6/1990

* cited by examiner

*Primary Examiner*—Janice L. Krizek
(74) *Attorney, Agent, or Firm*—Lanier Ford Shaver & Payne, P.C.

(57) ABSTRACT

An apparatus and method for lifting, rotating, and positioning heavy objects using a toggle device attached to a prime mover. The toggle is vertical at rest and can be inserted into the opening in the side of a pipe. The toggle is rendered horizontal inside the pipe by the activation of a solenoid and the pipe can then be lifted by the prime mover. The pipe can be rotated to any desired fixed position by a hydraulic cylinder moving a piston through a piston sleeve having spiral grooves. The entire lifting and positioning of a heavy object with the toggle device can be completed by a single user operating from within the prime mover. The present invention eliminates the hazards of workers getting buried in ditches and/or having their hands and fingers injured

20 Claims, 4 Drawing Sheets

APPARATUS AND METHOD FOR LIFTING AND ROTATING PIPES

BACKGROUND OF INVENTION

1. Field of the Invention

This invention relates to an apparatus and method for lifting pipes and related objects. More particularly, the invention relates to a magnetically activated toggle device which can be mounted on a prime mover, can raise and lower heavy objects, and can rotate or hold the objects in a fixed position.

2. Technical Background

Heavy, large pipes are used to transport fluids such as, for example, water, sewage, and gasoline. These pipes are usually lifted from trucks and lowered into ditches and removed in a similar fashion. Often these pipes are precast in concrete sections and have a hole in the side of the pipe at the lengthwise center of the section. A common method for lifting and lowering these pipes is to use a cable with a loop and a pin inserted through the loop. The cable is attached at one end to a crane and the loop is at the opposite end of the cable. The loop is passed through the hole in the pipe and advanced into the interior of the pipe. A person outside the pipe is required to pass the loop through the hole into the pipe and another person is required inside the pipe to insert a pin (such as a crowbar) through the loop, forming a toggle. The cable is then lifted until the pin engages the inside surface of the pipe. The pipe can then be lifted. This procedure is relatively dangerous to the person inside the pipe. The person inside the pipe usually has to hold the pin until the slack in the cable is taken up and to orient the pin along the longitudinal axis of the pipe. Accordingly, injuries to fingers and hands have been common using this method.

In order to overcome the problems associated with a person having to enter the interior of these pipes and manually place a pin, several toggle devices have been created. The toggle is attached pivotally to the end of a vertical shaft. The toggle is in a vertical position as it is passed through the hole in the pipe. Once inside the pipe, the toggle is switched to the horizontal position, extending beyond the diameter of the hole, so the pipe can be lifted. In most cases the toggle is weighted on one end so that it is maintained in a vertical position by gravity. Most of these toggles have a shaft, chain, or cable to pull them to a horizontal position. Others are pushed or pulled to a vertical position, being constructed to assume a horizontal position by the action of gravity. Yet others are constructed without shafts, chains, or cables and need to be rotated, swung, or shaken inside the pipe to get the toggle to deviate from vertical while pulling up on the cable. Further, known toggle devices rotate freely so that it is difficult to orient them properly inside the pipe and, once engaged with the pipe, the entire pipe can rotate freely. In practical use, more than on e per son is probably required to use these toggles for proper insertion and orientation. Once in place, the pipe has to be constrained, from rotation or guided for proper orientation.

What is needed, but not provided by know n toggle devices, is a toggle device that can be attached to a prime mover, that can be used by the operator of the prime mover without the need for assistance from other persons, and that can raise, lower, rotate, hold-fixed, and move the pipe forward or backward longitudinally.

SUMMARY OF THE INVENTION

The present invention is a toggle device constructed for insertion in to large pipes, tanks, reels, and the like, in order to safely lift, rotate, lower, and position these objects. The device has a shaft having a first end and an opposite end. The toggle is pivotally attached to the opposite end so as to be maintained in a vertical position by gravity. An arm is attached to the toggle so that when the arm is pulled towards the first end of the shaft, the toggle is pivoted to a horizontal position. The arm is pulled towards the first end of the shaft magnetically by activating a solenoid. The first end of the shaft is attached to a piston of a hydraulic cylinder and the piston has a pin or bolt perpendicular to the longitudinal axis of the piston. This pin fits in spiral grooves of a sleeve attached to the hydraulic cylinder. As the piston moves in and out of the hydraulic cylinder, the piston and the shaft rotate to any desire d position and can be maintained in that position by the hydraulic cylinder. In operation, the toggle in the vertical position is inserted into a pipe through a hole in the side of the pipe. An operator rotates the toggle with the hydraulic cylinder so the toggle will be parallel to the longitudinal axis of the pipe. The operator activates the solenoid to render the toggle horizontal and then lifts the toggle device with a prime mover to which the toggle device is attached. The toggle is then in contact with the inside wall of the pipe, across the hole in the pipe, and the pipe can be lifted, rotated, and lowered. Once lowered to the ground, the pipe can be moved forward or backward along its longitudinal axis by the prime mover pushing or pulling the toggle device. To remove the toggle device from the pipe, it is advanced into the pipe sufficiently for the toggle to assume a vertical position by gravity. The toggle device is then removed through the hole in the pipe.

An advantage of the present invention is a toggle device to lift heavy objects which can be operated by a single user.

Another advantage of the present invention is a toggle device that can be automatically operated by a user from a prime mover without the user contacting the toggle device.

Another advantage of the present invention is a toggle device that has a power-operated toggle.

Another advantage of the present invention is a power driven rotating mechanism that will rotate the lifted object to any fixed position and will align the object to mate with another object.

Another advantage of the present invention is that it can be attached to any suitable prime mover, such as, for example, a bucket, excavator, track-hoe, or back-hoe.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
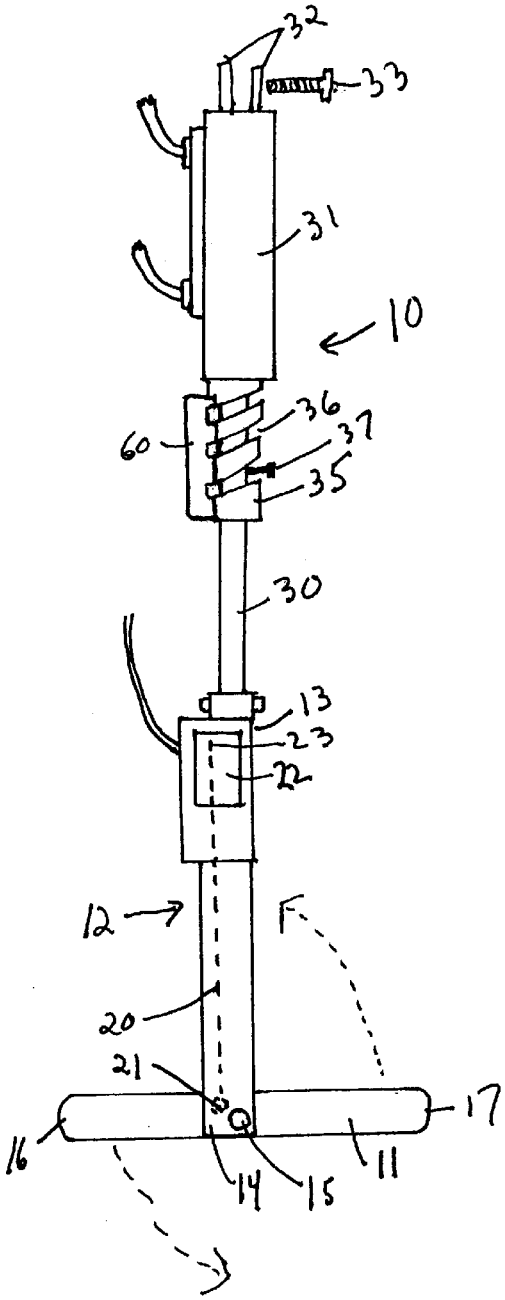
FIG. 1 shows a front perspective view of the toggle device of the present invention, with the toggle in the horizontal position.

FIG. 1 shows a front view of the toggle lifting device 10 of the present invention, with toggle 11 in the activated horizontal lifting position. In the context of the present invention, a toggle 11 is a blade-like structure which bridges an insertion opening from within an object in order to allow the object to be lifted. Toggle device 10 has a hollow shaft 12 having a first end 13 and an opposite end 14. Toggle 11 is pivotally attached to opposite end 14 by pivot bolt 15. Toggle 11 has a first end 16 and an opposite end 17, first end 16 being heavier than opposite end 17. Since first end 16 is heavier than opposite end 17, it will spontaneously rotate downward in response to gravity so that toggle 11 assumes a vertical position parallel to shaft 12.

Toggle 11 will remain vertical until it is activated by a force to become horizontal and perpendicular to shaft 12, as shown in FIG. 1. In order to activate toggle 11 an arm 20 is attached to toggle 11 at a point 21 distant from pivot bolt 15 towards the heavy end 16 of toggle 11. As arm 20 is pulled upward, heavy end 16 rotates upward to the horizontal position as shown in FIG. 1. If no force is applied to arm 20, end 16 will rotate downward and end 17 will rotate upward, as shown by the dashed arrows. Arm 20 is constructed of metal, preferably, a metal rod, and end 23 opposite attachment point 21 is inserted into a solenoid 22 which is positioned at first end 13 of shaft 12. When solenoid 22 is turned on it draws arm 20 upward, by magnetic force, towards first end 13 of shaft 12, pulling toggle 11 to the horizontal position. When solenoid 22 is turned off, toggle 11 will assume a vertical position, as arm 20 moves downward away from first end 13.

Shaft 12 has a piston 30 attached at first end 13. Piston 30 is part of a hydraulic cylinder 31 assembly. Hydraulic cylinder 31 has a prime mover attachment 32 for pivotal attachment to a prime mover by means of pivot bolt 33. Hydraulic cylinder 31 also has a piston sleeve 35 with spiral grooves 36. Spiral grooves 36 engage a piston bolt 37 fixed to piston 30. As piston 30 is drawn inward or pushed outward by hydraulic cylinder 31 through piston sleeve 35, piston bolt 37 engages spiral grooves 36 causing piston 30 to rotate, which in turn causes shaft 12 to rotate, and which causes an object engaged by toggle 11 to also rotate. Piston sleeve 35 is reinforced with brackets 60.

Figure 2:
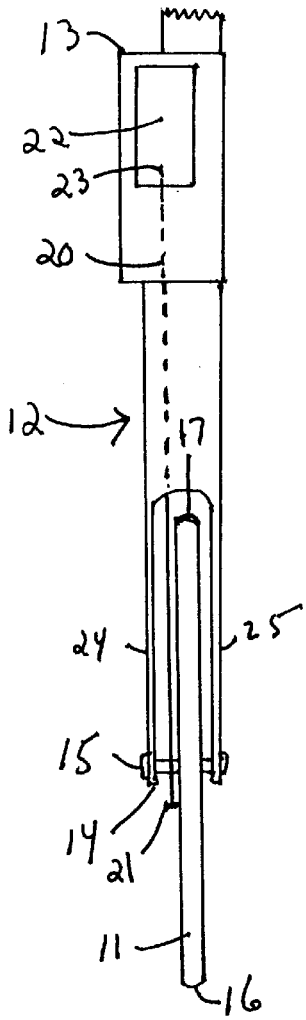
FIG. 2 shows a side view of the lower portion of the toggle device of the present invention.

FIG. 2 shows a side view of toggle lifting device 10 illustrating the attachment of toggle 11 to shaft 12. Shaft 12 is constructed, preferably, of hollow pipe with the lower portion cut open to accommodate toggle 11 vertically within shaft 12. When shaft 12 is so constructed it forms forks or legs 24 and 25 for the insertion of pivot bolt 15 through legs 24, 25, and toggle 11 at end 14 of shaft 12. Toggle 11 is shown in the vertical position within shaft 12 between legs 24 and 25, with end 23 of arm 20 pulled away from end 13 of shaft 12. When solenoid 22 is turned on, end 23 of arm 20 will be pulled toward end 13 of shaft 12, causing toggle 11 to pivot to the horizontal position, as illustrated in FIG. 1.

Figure 3:
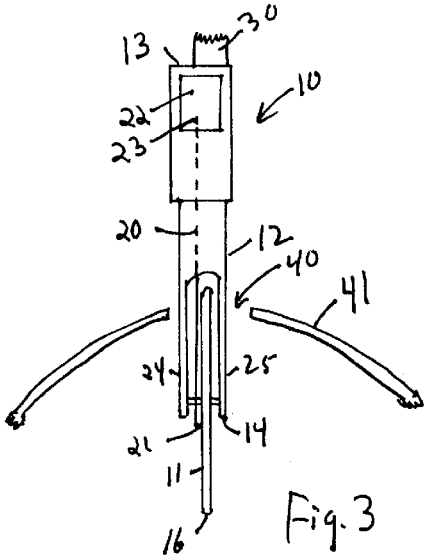
FIG. 3 shows a side view of the toggle being inserted into a pipe through a hole, viewed from the end of the pipe, with the toggle in a vertical position.

FIG. 3 illustrates the insertion of toggle 11 into an opening 40 of a pipe 41, viewed from the end of the pipe 41. Shaft 12 and toggle 11 are inserted through opening 40 while toggle 11 is in the vertical position between legs 24 and 25 of shaft 12.

Figure 4:
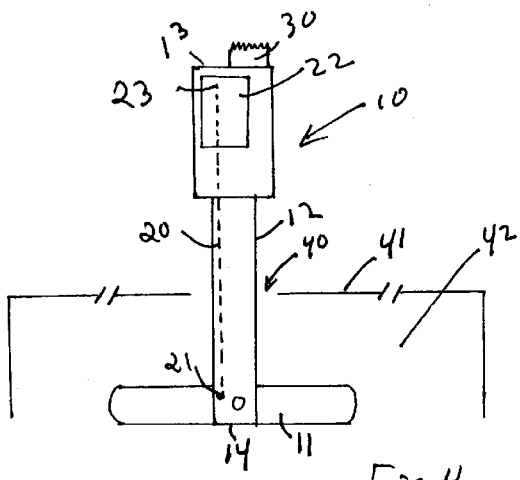
FIG. 4 shows a front view of the toggle inserted into the pipe, viewed from the side of the pipe, with the toggle in a horizontal position.
Figure 5:
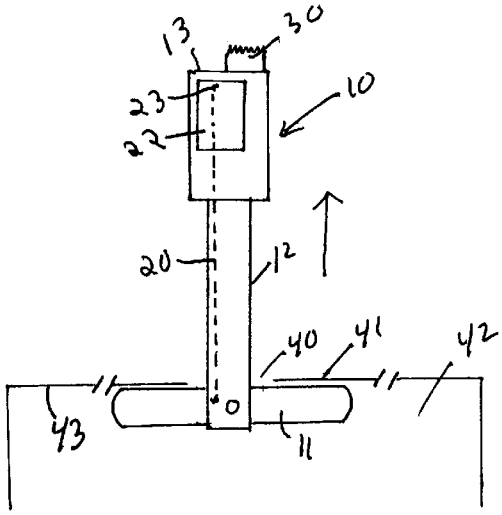
FIG. 5 illustrates the toggle pulled against the inner wall of the pipe bridging across the hole, in position for lifting the pipe.

FIG. 4 illustrates a side view of toggle 11 and shaft 12 in pipe 41. Shaft 12 is inserted far enough into pipe interior 42 of pipe 41 so that when solenoid 22 is turned on toggle 11 can be rotated to the horizontal position as end 23 of arm 20 is pulled magnetically towards end 13 of shaft 12. Toggle 11 can be oriented along the longitudinal axis of pipe 41 by rotating it into position using hydraulic cylinder 31, shown in FIG. 1. Toggle lifting device 10 is then pulled by a prime mover upward, shown by the arrow in FIG. 5, so that toggle 11 engages the inner wall 43 of pipe 41. The length of toggle 11 is longer than the diameter of hole 40 so that it will bridge hole 40. Solenoid 22 is depicted as still turned on in FIG. 5, but when toggle 11 makes contact with inner wall 43 solenoid 22 can be turned off. In use, solenoid 22 need be turned on only for a few seconds while raising toggle lifting device 10. Pipe 41 can now be lifted (shown by the solid arrow) with toggle lifting device 10 attached to a prime mover.

Figure 6:
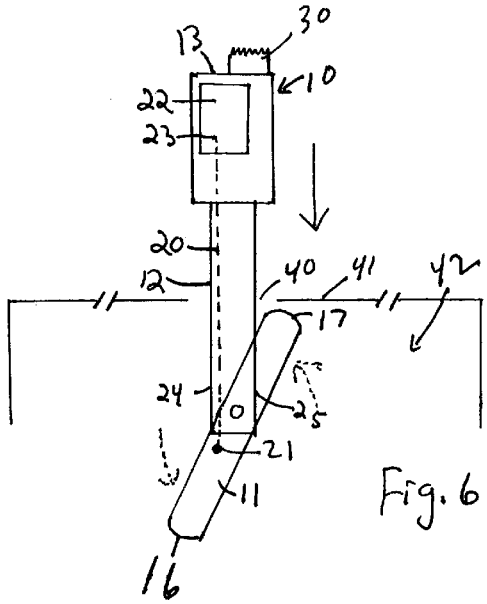
FIG. 6 illustrates the toggle being lowered back into the pipe, after the lifting procedure, so that the toggle may assume a vertical position and be removed from the pipe through the hole.

After the lifting procedure is completed, toggle lifting device 10 can be removed from pipe 41 as depicted in FIG. 6. Toggle lifting device 10 is lowered (shown by the solid arrow) into the interior 42 of pipe 41 by the prime mover so that toggle 11 is free to pivot, and so that heavy end 16 of toggle 11 will automatically rotate downward, and opposite end 17 upward, as shown by the dashed arrows. Arm 20 also moves downward, away from end 13 of shaft 12. When toggle 11 is again in between legs 24, 25, toggle 11 and shaft 12 can be withdrawn from pipe 41 through opening 40 by the prime mover.

Figure 7:
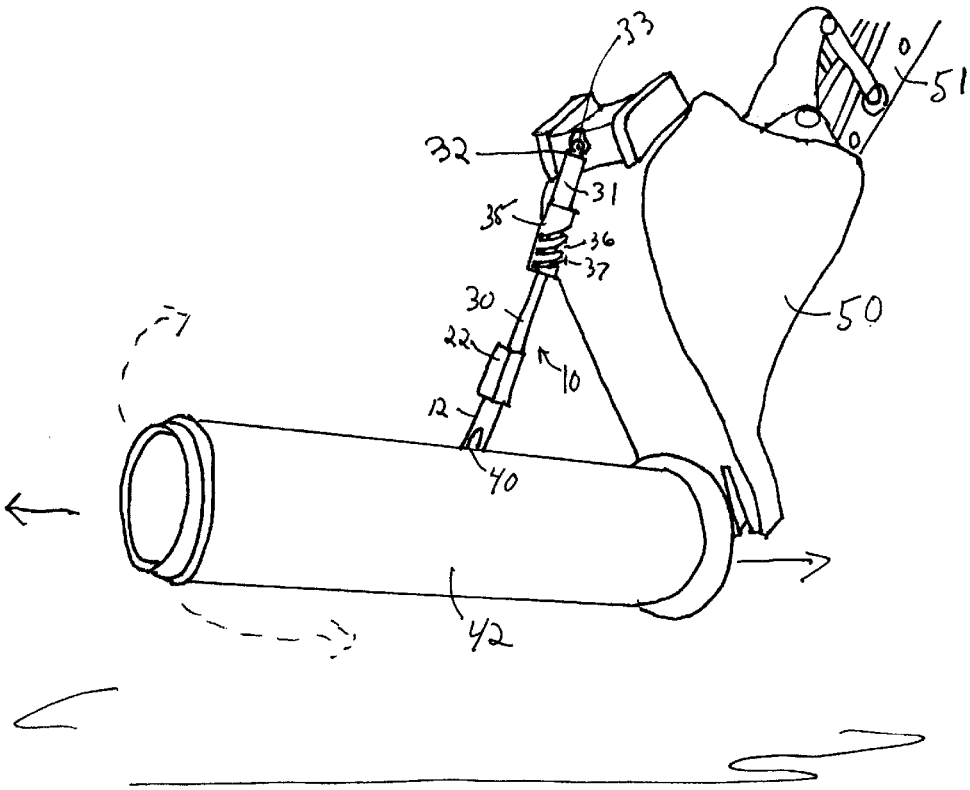
FIG. 7 shows the toggle device of the present invention attached to a prime mover, and the prime mover lifting a pipe with the toggle inserted into the pipe.
Figure 8:
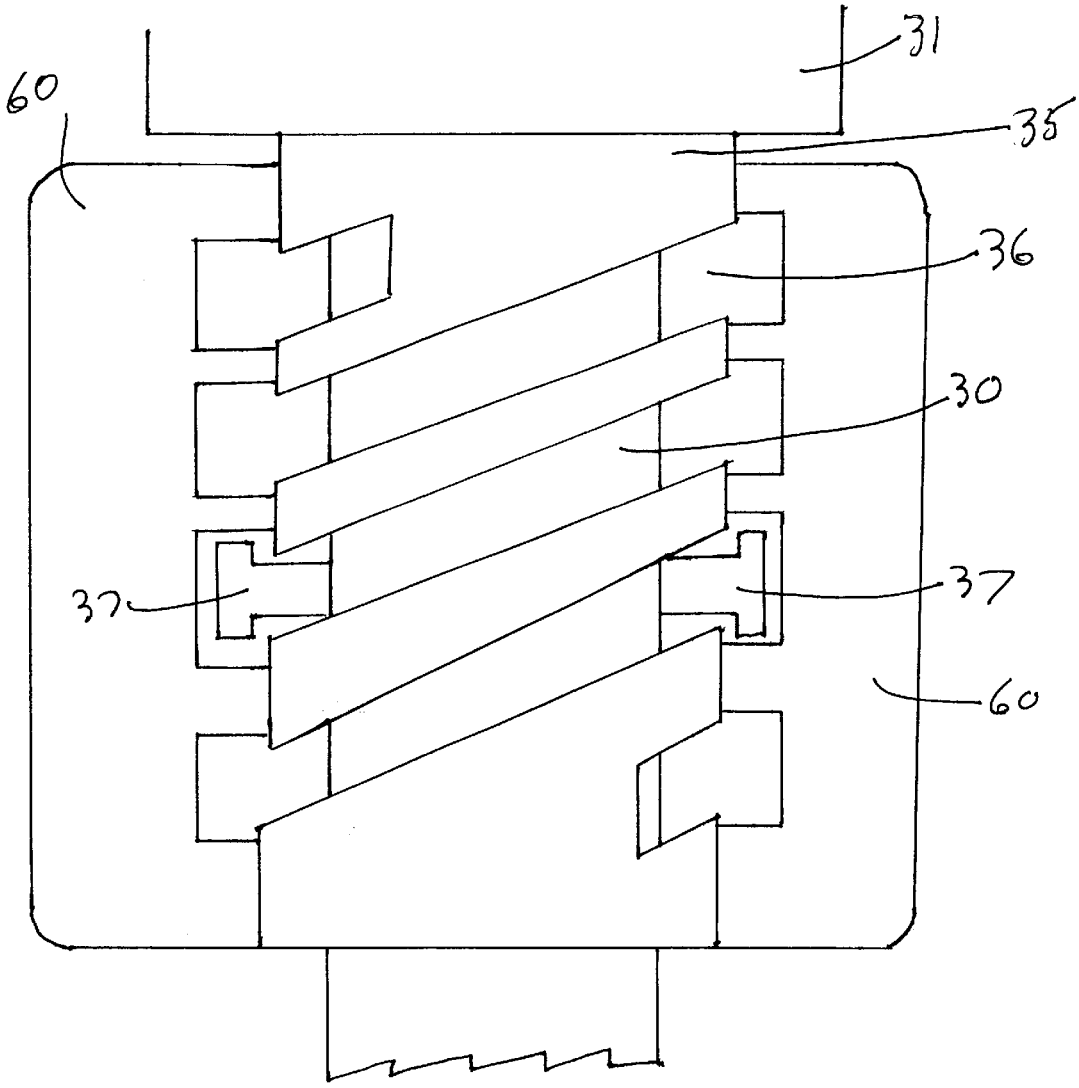
FIG. 8 illustrates the piston sleeve with the piston bolt positioned within the spiral grooves of the piston sleeve.

FIG. 7 shows the toggle lifting device 10 of the present invention attached pivotally to a bucket 50 on a prime mover 51 with attachment 32 and pivot bolt 33. Shaft 12 and toggle 11 are inserted into pipe 41 through opening 40 and prime mover 51 has lifted pipe 41 off the ground. Pipe 41 can be rotated clockwise or counter clockwise, about the axis formed by shaft 12, by activating hydraulic cylinder 31 to extend or withdraw piston 30 through piston sleeve 35. Spiral grooves 36 in piston sleeve 35 and piston bolt 37 are shown in greater detail in FIG. 8. Spiral grooves 36 will cause piston 30 to rotate as the spiral grooves 36 encounter piston bolt 37 on piston 30 as piston 30 is extended into or withdrawn from hydraulic cylinder 31. Piston sleeve 35 is reinforced with brackets 60. Prime mover 51 can advance pipe 41 forward or backward along the longitudinal axis of pipe 41, shown by the solid arrows, by pushing or pulling the toggle.

In the application of toggle lifting device 10, attached to bucket 50 of prime mover 51, a user can be seated in the cab of the prime mover and perform all the operations necessary to lift, orient, and lower a pipe or similar object, without having to directly contact toggle lifting device 10 and without needing the assistance of another worker. For example, the user in the cab of the prime mover 51 would first rotate shaft 12 to properly align toggle 11 along the longitudinal axis of pipe 41 by turning on hydraulic cylinder 31. After alignment, the user would lower toggle 11 and shaft 12 into opening 40 by lowering toggle lifting device 30 with prime mover 51. Once toggle 11 and shaft 12 are within pipe 41 the user would turn on solenoid 22 to place toggle 11 into a horizontal position and then lift toggle lifting device 10 until toggle 11 engages the inner wall 43 of pipe 42. Solenoid 22 is then shut off. The user then lifts the pipe 41 with prime mover 51. The user can then rotate pipe 41 as needed by activiating hydraulic cylinder 31. The pipe 41 is then lowered into a ditch, for example, and pipe 41 can be aligned by rotation as described above and positioned forward or backward as needed, for example, to mate the pipe with another pipe in the ditch, by the prime mover pushing or pulling the toggle. The user then removes toggle 11 and shaft 12 from pipe 41 by lowering toggle 11 and shaft 12 into the interior 42 of pipe 41 until toggle 11 is free to assume a vertical position in shaft 12 automatically in response to gravity. Toggle 11 and shaft 12 are then removed from pipe 31 through opening 40 by lifting the toggle lifting device 10 with prime mover 51.

The use of the present invention eliminates the need for a worker to get into the ditch to align the pipe for mating with another pipe or to disconnect a cable from a pipe. The present invention also reduces the amount of excavation required because there is no need to slope the banks of the ditch or to use a trench box to protect workers who would otherwise need to get into the ditch to align and release the pipe. The present invention, thus, eliminates the hazards of workers getting buried in ditches and/or having their fingers and hands injured.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the lifting device of the present invention can be used with tanks and reels. The prime mover can also be an excavator, track hoe, or back hoe. The solenoid and hydraulic cylinder can be powered by the prime mover. An electric motor or pneumatic pump can be used instead of a hydraulic cylinder.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. An apparatus for lifting and rotating objects, comprising:

a) a shaft having a first end and an opposite end;

b) a toggle pivotally attached to said opposite end of said shaft, and being held in a vertical position by gravity;

c) said toggle having an arm to place said toggle in a horizontal position;

d) said shaft having a first power-driven mechanism to activate said arm to place said toggle in said horizontal position; and e) said first end of said shaft having a second power-driven mechanism to rotate said shaft to desired positions and to maintain said shaft in the desired positions.

2. The apparatus of claim 1 wherein said first power-driven mechanism is a solenoid.

3. The apparatus of claim 2 wherein said second power-driven mechanism is a hydraulic cylinder with a piston, said piston connected to said first end of said shaft.

4. The apparatus of claim 3 further comprising a piston sleeve with helical grooves attached to said hydraulic cylinder to rotate said piston and said shaft.

5. The apparatus of claim 4 wherein said hydraulic cylinder has a connecting member to pivotally connect said hydraulic cylinder to a prime mover, said prime mover providing power to operate said solenoid and said hydraulic cylinder.

6. The apparatus of claim 2 wherein said solenoid is connected to said first end of said shaft.

7. The apparatus of claim 6 wherein said arm is a metal rod.

8. An apparatus for lifting and rotating objects, comprising:

a) a shaft having a first end and an opposite end;

b) a toggle pivotally attached to said opposite end of said shaft, and being held in a vertical position by gravity;

c) said toggle having a metal rod to place said toggle in a horizontal position;

d) said shaft having a solenoid to move said metal rod to place said toggle in said horizontal position;

e) a hydraulic cylinder having a piston, said piston connected to said first end of said shaft; and f) a piston sleeve with helical grooves to rotate said piston and said shaft by said hydraulic cylinder moving said piston through said piston sleeve.

9. The apparatus of claim 8 wherein said hydraulic cylinder has a connecting member to pivotally connect said hydraulic cylinder to a prime mover, said prime mover providing power to operate said solenoid and said hydraulic cylinder.

10. The apparatus of claim 9 wherein said piston sleeve is connected to said hydraulic cylinder.

11. The apparatus of claim 10 wherein said solenoid is connected to said first end of said shaft.

12. A method for lifting and rotating objects, comprising the steps of:

a) inserting a toggle into an object through an opening, said toggle being in a vertical position;

b) placing said toggle in a horizontal position across said opening by activating a first power-driven mechanism;

c) lifting the object by lifting said toggle;

d) rotating said object to any desired position and maintaining the object in said desired position by operating a second power-driven mechanism;

e) lowering said toggle into said object after said lifting step is completed so that said toggle assumes a vertical position inside said object; and f) removing said toggle from said object through said opening.

13. The method of claim 12 wherein the steps of inserting, lifting, lowering, and removing comprise attaching said toggle to a prime mover and inserting, lifting, lowering, and removing said toggle using said prime mover.

14. The method of claim 12 wherein the step of placing said toggle in a horizontal position comprises a solenoid pulling on a bar.

15. The method of claim 12 wherein the step of rotating comprises pushing or pulling a piston with a hydraulic cylinder.

16. The method of claim 12 further comprising the step of moving said object forward or backward by pushing or pulling said toggle with said prime mover.

17. A method for lifting and rotating objects, comprising the steps of:

a) attaching a toggle pivotally to a prime mover;

b) inserting said toggle into an object through an opening using said prime mover, said toggle being in a vertical position;

c) placing said toggle in a horizontal position across said opening by activating a solenoid to pull a bar;

d) lifting said object by lifting said toggle using said prime mover;

e) rotating said object to any desired position and maintaining the object in said desired position by pushing or pulling a piston with a hydraulic cylinder;

f) lowering said toggle into said object using said prime mover after said lifting step is completed so that said toggle assumes a vertical position inside said object; and g) removing said toggle from said object through said opening using said prime mover.

18. The method of claim 17 further comprising the step of moving said object forward or backward by pushing or pulling said toggle using said prime mover.

19. The method of claim 17 further comprising the step of providing power to said solenoid and to said hydraulic cylinder from said prime mover.

20. The method of claim 17 wherein steps b through g are performed by a single user operating entirely within said prime mover without the help of an additional worker.

* * * * *